United States Patent [19]

Franz et al.

[11] 4,252,049

[45] Feb. 24, 1981

[54] CARTRIDGE FEED SYSTEM FOR AUTOMATIC WEAPONS

[75] Inventors: Dolf Franz, Kaufbeuren; Armin Brunner, Marktoberdorf; Albert Wüst, Oberengstringen, all of Switzerland

[73] Assignee: Werkzeugmaschinenfabrik Oerlikon-Bührle AG, Zürich, Switzerland

[21] Appl. No.: 943,956

[22] Filed: Sep. 20, 1978

[30] Foreign Application Priority Data

Sep. 28, 1977 [CH] Switzerland ..... 11847/77

[51] Int. Cl.[3] ..... F41D 10/22

[52] U.S. Cl. ..... 89/34

[58] Field of Search ..... 89/1.801, 1.804, 33 BB, 89/33 BC, 33 SF, 34; 221/121, 122, 87, 88

[56] References Cited

U.S. PATENT DOCUMENTS

| | | | |
|---|---|---|---|
| 2,489,428 | 11/1949 | Mariner | 89/33 BB |
| 3,370,506 | 10/1955 | Altschuler et al. | 89/33 BC |

*Primary Examiner*—Stephen C. Bentley

*Attorney, Agent, or Firm*—Werner W. Kleeman

[57] ABSTRACT

In the case of cartridge feed systems for automatic weapons or guns having an endless chain for feeding and storing the cartridges there is provided an outfeed mechanism for outfeeding the cartridges by means of the feed or conveying movement of the chain. In order to be able to store a number of different types of ammunition with such equipment and to be able to infeed such to the weapon or gun, the invention contemplates utilizing an outfeed mechanism wherein it is possible to selectively outfeed cartridges in both feed or conveying directions of the endless chain.

12 Claims, 8 Drawing Figures

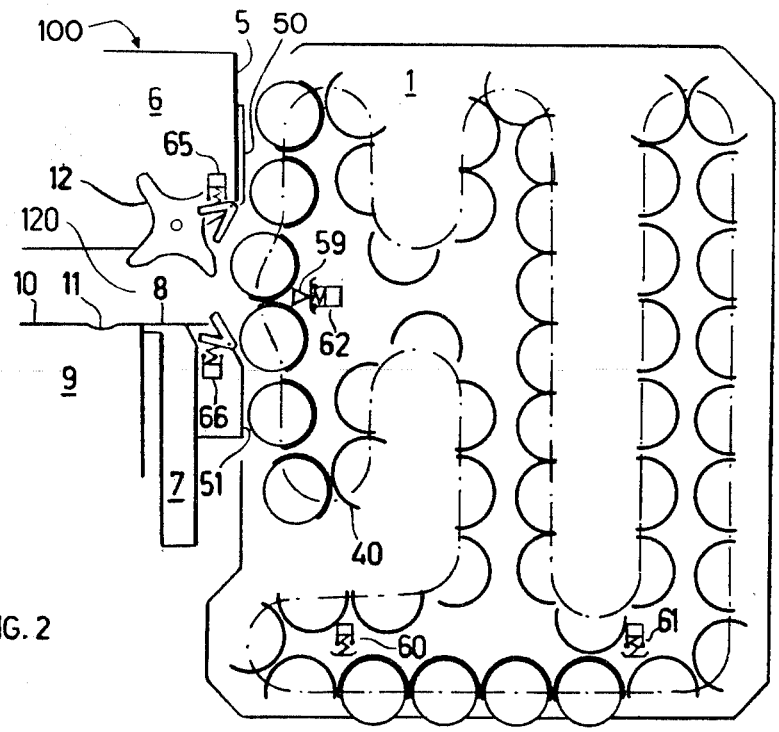
FIG. 2
FIG. 3
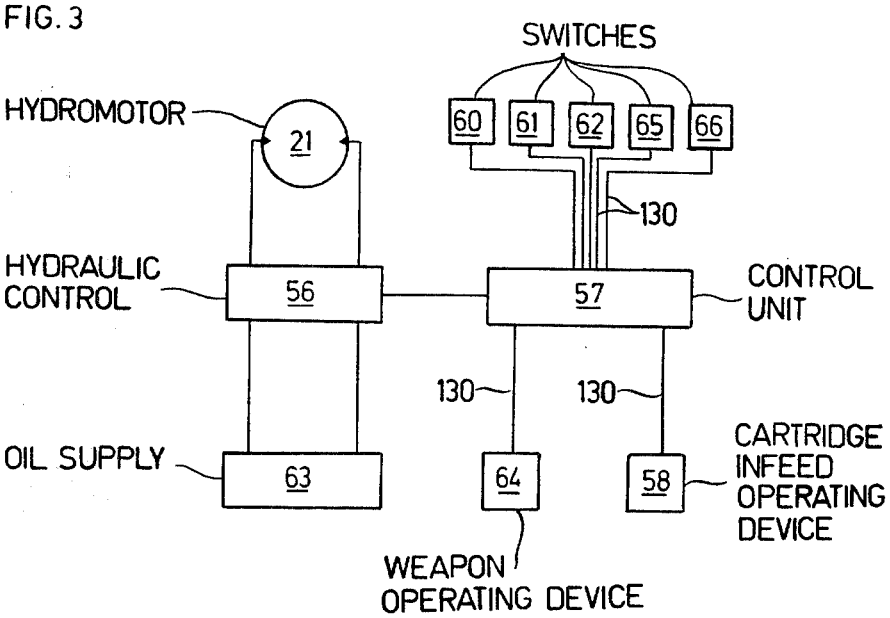

CARTRIDGE FEED SYSTEM FOR AUTOMATIC WEAPONS

BACKGROUND OF THE INVENTION

The present invention relates to a new and improved construction of cartridge feed or infeed system for automatic weapons or guns and which is of the type comprising an endless chain for the conveying and storage of the cartridges and having an outfeed mechanism for outfeeding the cartridges by means of the movement of the chain.

In U.S. Pat. No. 2,489,428 there is taught a known cartridge feed system of this type wherein the outfeed mechanism consists of strippers arranged transversely with respect to the chain and which protrude into the path of travel of the cartridges which for purposes of firing the same are always conveyed in the same direction. These strippers are fixedly mounted. If, for instance, it is desired to infeed to the gun two different types of ammunition, then it is necessary to either know ahead of time the exact sequence in which there are required the different cartridges, or it is necessary to initially fire cartridges of the first type, in order to then be able to fire cartridges of the second type.

In German patent publication No. 25 01 425 there is disclosed a projectile feed system where it is possible to store different types of ammunition at a chain and to infeed such to the weapon. However, this feed system is only suitable for infeeding ammunition to a gun operating at a low cadence, since the transfer of the ammunition to the weapon can only be accomplished when the chain is stationary.

SUMMARY OF THE INVENTION

Hence, it is a primary object of the present invention to provide a new and improved construction of cartridge infeed system for automatic weapons or guns which is not associated with the aforementioned drawbacks and limitations of the prior art proposals.

Another and more specific object of the present invention aims at the provision of a new and improved construction of cartridge infeed system for storing at least two different types of ammunition, each of which can be infed in a randomly selectable sequence to the gun.

Now in order to implement these and still further objects of the invention, which will become more readily apparent as the description proceeds, the cartridge feed system of the present development is manifested by the features that the outfeed mechanism is constructed and arranged for outfeeding the cartridges in both feed or conveying directions of the endless chain.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2 schematically illustrates a sectional view of the cartridge feed system of FIG. 1, taken substantially along the line I—I thereof;

FIG. 3 illustrates a block circuit diagram of the control and operating device used for the cartridge feed system of FIGS. 1 and 2;

DETAILED DESCRIPTION OF THE PREFERRED EMBODIMENTS

Figure 1:
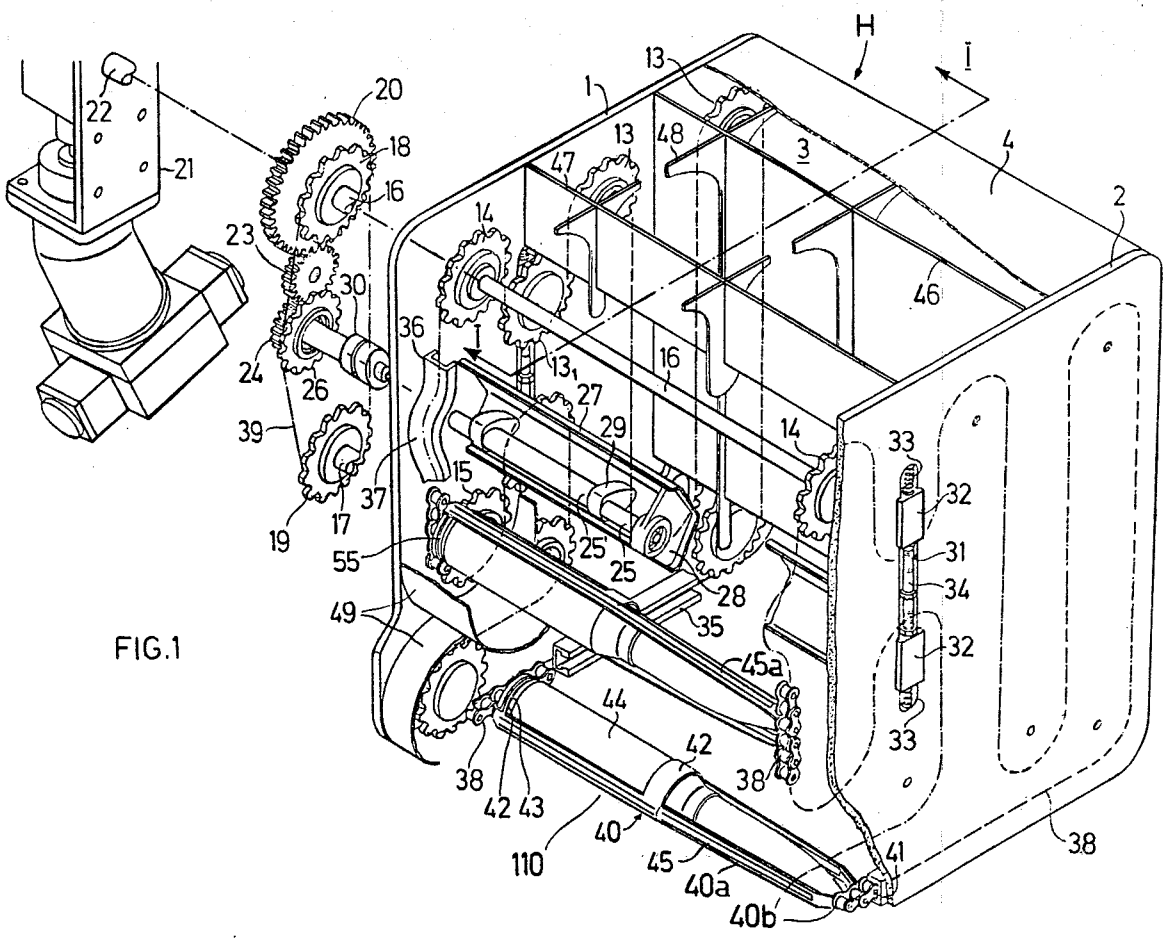
FIG. 1 is a perspective illustration of a cartridge infeed or feed system constructed according to the invention and partially shown in cutaway view.

Describing now the drawings, according to the showing of FIG. 1 a cartridge feed system or apparatus as contemplated by the present invention will be seen to comprise a housing H containing a rear wall 1 and a front wall 2. These parallel walls 1 and 2 are interconnected with one another by a side wall 3 aligned perpendicular to the walls 1 and 2 and a cover member or cover 4 to form such housing H. As best seen by referring to FIG. 2, the apparatus is attached in basically known and therefore not further illustrated manner to the side wall 5 of a weapon housing, generally indicated by reference character 100.

The connection contours of the weapon have been partially shown in FIG. 2 as follows:

At a rear wall 6 of the weapon housing 100 there is attached a plate 7 whose end surface forms a guide surface 8 for cartridges. The guide surface 10 of a cartridge infeed plate 9 arranged in the weapon housing is located, just as the surface 8, in a plane directed perpendicular to the rear wall 6 of the weapon housing and the rear wall 1 of the cartridge feed apparatus and has a recess 11 for the reception of the cartridges. An indexing or switching wheel 12 is arranged above the guide surface 8 of the plate 7 and is rotatably mounted in the housing rear wall 6. The drive device for the indexing wheel 12 is advantageously of the type described and illustrated in Swiss patent No. 593,475, to which reference may be readily had and the disclosure of which is incorporated herein by reference.

At the inside of both walls 1 and 2 there are arranged in pairs at the same axis oppositely situated sprocket wheels or gears 13. In the same manner there are arranged two further pairs of drive gears 14 and 15. However such drive gears 14 and 15 are keyed or otherwise affixed to the shafts 16 and 17. Externally of the housing there are keyed to these shafts 16 and 17 also the sprocket wheels 18 and 19 and there is additionally keyed to shaft 16 a spur gear 20. The shaft 16 is in drive connection with the shaft 22 of a hydromotor 21 flanged to the housing wall 1 and reversible for both rotational directions. The spur gear 20 meshes with a gear 23 which is in engagement with a spur gear 24. The gear 24 is keyed to the shaft 25 at which there is freely rotatably mounted a sprocket wheel 26.

A part of the shaft 25 is arranged within the housing H and partially surrounded by an angled protective plate 27 which is attached at the walls 1 and 2 and illustrated in cutaway view in FIG. 1. Attached therein is the bearing support 28. Two cams 29 are fixedly arranged in the illustrated form and manner at this part of the shaft, referred to as cam shaft 25', and thus form an outfeed or stripper component. Externally of the housing H the shaft sections or parts 25 and 25' are divided by an indexable or switchable coupling 30, so that there can be interrupted the drive connection between the gear 24 and the cam shaft 25'. Both of the shafts 16 and 17 are arranged at the same spacing from the axis of the cam shaft 25'. All of the shafts and gears are mounted in conventional and therefore here not further illustrated and described manner.

The walls 1 and 2 each have a slot 31, the center line of each of which is located in a plane which is essentially parallel to the plane containing the axes of the shafts 16 and 17. In each slot 31 there are displaceably inserted two slide or pusher elements 32. Mounted at each slide or pusher element 32 is a sprocket wheel or gear $13_1$, as best seen by referring to FIG. 1. These slides or pusher elements 32 bear under the pressure of springs 33 arranged between them and the base of the slots 31 at a related rod or bar 34. In the rest position the sprocket gears $13_1$, likewise mounted upon the slides or pusher elements 32, each have the same spacing from the shafts 16 and 17 respectively.

At the walls 1 and 2 there are attached two pairs of rails 35 and 36 having a substantially U-shaped cross-sectional configuration. The rail pair 35 is arranged at the lower end of the housing H at the region of an inlet opening 110. The rails 36 of the second rail pair are arranged between the cam shaft 25' and the switching or indexing wheel 12. The rails 36 possess an intermediate or central piece 37 flexed towards the weapon housing 100, and their ends are parallel to the plane of the axes of the shafts 16 and 17. At the inside of the walls 1 and 2 there are mounted by means of the sprocket wheels 13, 14 and 15 two endless roll chains 38, and the rails 35 and 36 constitute rigid guides for such two endless roll or roller chains 38. Furthermore, by means of a chain 39 which is trained about the wheels 18, 19 and 26 or equivalent structure there is established a direct drive connection between the shaft 22 and the shaft 17 or stated in another way between the shaft 16 and the shaft 17. The transmission ratio of the gears 20 and 24 is chosen such that the cam shaft 25' accomplishes one revolution when the chain 38 is moved through a path corresponding to the spacing between two subsequently described cartridge holders 40.

Each cartridge holder 40 consists of an elongate sheet metal frame **40*a* or equivalent structure whose two narrow sides 40*b* are attached to two roll bolts 41 of the oppositely situated chains 38. The lengthwise sides 45 of the frame 40*a* are connected at one side with one another by two curved brackets or straps 42**.

A fixing element in the form of, for instance, a reinforcement fin or finger 43 of the rear bracket 42 engages into a withdrawal groove 55 of the related cartridge 44. Consequently, the cartridge 44 is fixed in its lengthwise direction in the cartridge holder 40. The lengthwise sides 45 of the frame **40*a* are constructed as outwardly arched or domed bands 45*a*, and thus must be spread apart somewhat upon infeeding a cartridge 44 into the cartridge holder 40. As a result, there is exerted a holding force upon the cartridges 44. The cartridge holders 40 are attached at the chains 38 at the same spacing from one another. In the description to follow both of the chains 38 with the cartridge holders 40** will be briefly referred to as the chain or the chain means.

Between the walls 1 and 2 there are fixedly clamped the supports or carriers 46 and 47 and at such there are attached the guide plates 48 for guiding the cartridges 44 moved in the holders 40. Semi-circular shaped and flexed guides 49 augment this arrangement. At the weapon housing 100 and at the plate 7 there are furthermore arranged the guides 50 and 51 as best seen by referring to FIG. 2.

Further by referring to such FIG. 2 there will be seen that switches 60, 61 and 62 are arranged along the chain and which can be activated by a switching cam 59 or equivalent structure. Such switching cam 59 is attached at the chain between two neighboring cartridge holders 40. Switch 62 is arranged at the apex of the arched central or intermediate piece 37 of the rails 36. The switches 60 and 61 are located at respective sides of an infeed opening. Further switches 65 and 66 are arranged at respective sides of a channel 120 which is part of the weapon housing 100 and are actuated by the cartridges 44. Of course, apart from using the switching cam 59 for actuating the switches it is possible to use other elements, such as for instance magnets and the like.

In order to control the hydromotor 21, driving the chain by means of the shaft 22, there is arranged between such hydromotor 21 and the oil supply 63 of the automatic gun or firing weapon a hydraulic control device 56, as best seen by referring to FIG. 3. Magnetic valves of this hydraulic control device or unit are connected by means of electrical lines with the electronic control unit 57. This electronic control unit 57 is connected by means of various electrical lines 130 with the weapon operating device 64, the operating device 58 of the cartridge infeed apparatus and the switches 60, 61, 62, 65 and 66.

Hydromotor 21, oil supply 63, control unit 56, electronic control device 57, the cartridge infeed operating device 58 and the weapon operating device 64 are here not further described. They operate according to known principles and the individual functions which they must fulfil will be apparent from the description of the mode of operation of the system as described hereinafter.

Specifically now the mode of operation of the exemplary embodiment, which should be apparent from the aforedescribed construction, will be considered and is as follows:

In order to load the apparatus with cartridges 44 the coupling 30 is disconnected to thereby place out of operation cam shaft 25', the cams 29 of which then are located in the position illustrated in FIG. 1. This disconnection of the coupling 30 is accomplished by means of a not further illustrated lever or by means of the operating device 58. By means of the hydromotor 21 there is driven by means of the shaft 22 the shaft 16 with the sprocket gears 18 and 14, and thus the chains 38 and 39. The shaft 17 having the sprocket gear or wheel 15 and driven by the chain 39 thus forms a further drive of the chain 38. For loading the empty chain is initially slowly selectively moved in one of both directions for such length of time until the switching cam 59 activates one of the switches 60 or 61, and thus, turns-off the hydromotor 21.

During loading the control commands are infed via the operating device 58 to the control unit 57. If, for instance, the switch 60 is activated by the switching cam 59, and thus, there is turned-off the drive, then for the loading operation the hydromotor 21 is again turned-on by means of the operating device 58 and the chain is slowly moved further in the clockwise direction together with the switching cam 59. Consequently, the empty cartridge holders 40 are guided along the open underside or opening 110 of the housing H and loaded in that the cartridges 44 are pushed into the housing H from below. The rails 35 prevent movement of the chains 38 towards the interior of the housing H. If in this manner the chain has been loaded with a certain number of cartridges of one type and if it is desired to infeed a number of cartridges of a different type, then the chain, without being loaded, must be further driven until this time the switching cam 59 turns-off the drive by means of the switch 61. For loading of cartridges of the other type the chain now is driven in the counterclockwise direction until the desired number of cartridges are infed, or until all of the cartridge holders 40 of the chain are provided with a cartridge. Then the chain is moved slowly further until the switching cam 59 activates the switch 62, and thus, there is turned-off the hydromotor 21.

During firing the control commands are infed via the weapon operating device 64 to the control device or unit 57. Depending upon which direction of rotation of the chain is selected, there are outfed or stripped cartridges of the one or the other type. Additionally, the chain is driven at a higher speed than during the charging or loading operation.

The coupling 30 now is again engaged or turned-on. A first cartridge of the selected type, as will be explained more fully hereinafter, is thus partially outfed or stripped to such an extent until it impinges against the indexing wheel 12 of the weapon. The drive is then, depending upon the direction of rotation of the chain, turned-off by one of the switches 65 or 66. Hence, the system is now ready for cartridge outfeeding or stripping.

Figure 4:
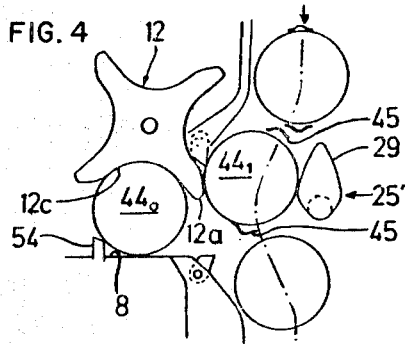
FIGS. 4, 5 and 6 schematically illustrate different phases of the outfeeding or stripping of a cartridge from a cartridge holder or support for the one feed direction of the chain.

With the illustration of FIG. 4 it is assumed that in the non-shown barrel of the weapon, to which there should be infed ammunition from the cartridge feed apparatus or system, there is located a cartridge and at the guide surface 8 there is retained a cartridge $44_0$ in a recess or pocket 12*c* of the indexing wheel 12. Now if the fire key at the weapon operating device 64 is depressed, then there is fired the weapon and the chain is driven by the hydromotor 21 in the direction of the arrow. During such time as the chain moves the cams 29 rock the shaft 25' driven by means of the gears or wheels 20, 23 and 24 in the counterclockwise direction, and thereby impact against the cartridge $44_1$. This cartridge $44_1$ is moved out of both longitudinal or lengthwise sides 45 of the holder until it strikes against the teeth 12*a* of the still stationary indexing or switching wheel 12, and the hydromotor 21 begins to work in the overload mode. A movable blocking device 54 which is schematically shown in the drawings and engaging at the cartridge $44_0$, prevents that the indexing wheel 12, under the action of the force exerted by the cartridge $44_1$ can rotate in the clockwise direction. As a result the chain is stopped.

Figure 5:
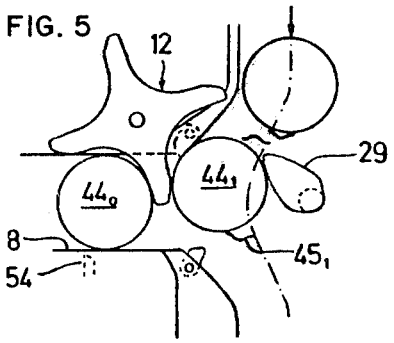
Figure 6:
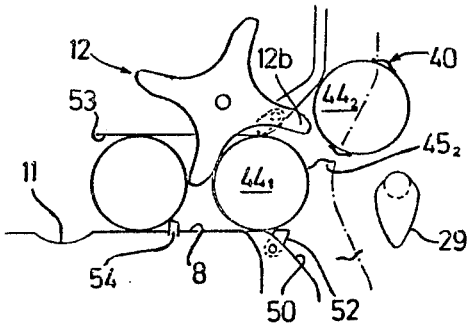

If the weapon barrel, after firing a cartridge or round, has moved back through a certain path, then the indexing wheel 12 begins to rotate (FIG. 5) and, after having released the blocking device 54, further displaces the cartridge $44_0$ upon the surface 8. Under the pressure of the cams 29 and the now again moved chain the cartridge $44_1$ remains in contact with the rotating indexing wheel 12 and is supported by the front longitudinal side $45_1$ of the cartridge holder from which the cartridge is completely stripped or outfed. During the further movement the cartridge $44_1$ bears upon the pawls 52 or equivalent structure which are articulated at the guides or guide means 50. When the cams 29 are rocked away from cartridge $44_1$, then the rear longitudinal side $45_2$ of the cartridge holder comes into contact therewith and moves such forwards, as best seen by referring to FIG. 6, until it is engaged by the serrations or teeth 12*b* of the indexing wheel 12 and moves further into the channel limited by the guides or guide means 8 and 53. At the end of the switching movement through 90° the switching or indexing wheel 12 again assumes the position shown in FIG. 4 where it remains for a certain amount of time. During the rotation through 90° the indexing wheel 12 moves a cartridge, for instance designated by reference character $44_0$, into the loading position at the recess or depression 11 from which it is propelled in a further not particularly illustrated manner into the weapon barrel of the gun. The chain moves further until the cartridge $44_2$ impacts against the teeth or serrations 12*b* of the indexing wheel 12 which is again blocked by the blocking device 54, whereupon such remains stopped until after firing the next shot. Upon renewed rotation of the indexing wheel 12 there repeats the previously described stripping or outfeed of the cartridge $44_2$ from the holder 40.

Figure 7:
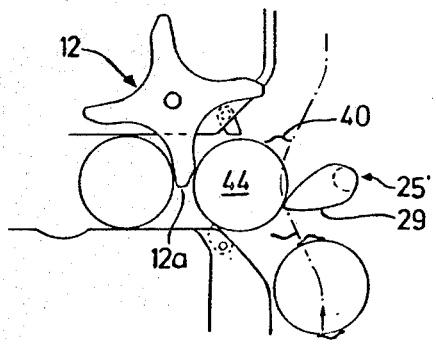
FIGS. 7 and 8 are views corresponding to the showings of FIGS. 4 to 6 for the other feed direction of the chain.
Figure 8:
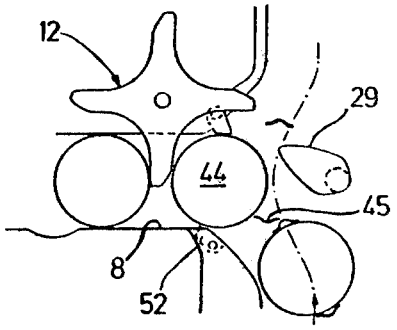

If ammunition of a second type should be conveyed to the weapon then the hydromotor 21 is reversed so that it now rotates in the other directional sense. The feed or conveyor chains 38 are thereupon moved for such length of time in a direction, indicated by the arrow of FIG. 7, and opposite to the direction of feeding of the ammunition of the first type, until the first cartridge of the second type has activated the switch 65 or the switch 66 and has turned-off the hydromotor 21. During the subsequent stripping or outfeed operation the chain and the cam shaft 25 operate in the reverse manner than their mode of operation during outfeed of the first type of ammunition. The cartridge 44 is now stripped out of the cartridge holder 40 by means of the cams 29 and pressed against the teeth or serrations 12*a* of the indexing wheel 12. The lengthwise sides 45 of the frame 40*a* of the cartridge holder 40, as best seen by referring to FIGS. 7 and 8, now assume the guide functions for the cartridge 44 which is moved by means of the pawl 52 onto the guide surface 8.

The indexing wheel 12, after firing of a shot, accomplishes a rotation through 90° during a time span which approximately amounts to one-sixth of a firing interval. As will be explained in the subsequent portion of this description, during this very short time span it is unnecessary to accelerate out of the rest position the entire cartridge supply present in the apparatus, which for instance cam amount to a maximum of fifty cartridges, and to move such through a path corresponding to the spacing of two cartridge holders 40.

It is assumed that the direction of movement of the chain is such that the cartridges 44 at the region of the stripping or outfeed location according to FIG. 1 are conveyed from the top towards the bottom. With the rotation of the indexing wheel 12 there is initiated the rotation of the shaft 16 and there is also placed into rotation the shaft 17 which is driven by the shaft 16 by means of the chain 39. By virtue of the sprocket gears 14 and 15 which rotate in the counterclockwise direction the chain 38 is drawn through the rails 36. The traction forces exerted by the chains 38 upon the sprocket gears or wheels $13_1$ cause an upward displacement of the slides or pusher elements 32 at which there are mounted the gears or wheels $13_1$. Due to this displacement of the sprocket gears or wheel $13_1$ initially there is not entrainably moved the part of the chain 38 located behind the wheels $13_1$. Since the chain 38 only can transmit to a limited degree compressive forces, there also is initially not accomplished any drive of the parts of the chain 38 located in front of the wheels or gears 15. Therefore, it is only necessary to accelerate the parts of the chain 38 having the cartridges 44 which are located between both of the wheel pairs 14 and 15, something which is possible with drive forces and power outputs which are appreciably smaller than those which are needed for the simultaneous acceleration of the entire contents of the container or magazine.

If the acceleration movement of the chain 38 is transformed into a more uniform movement as determined by the indexing wheel 12 and if the traction or tensile forces of the chain 38 are smaller, then the slides or pusher elements 32 together with the sprocket wheels $13_1$ move under the pressure of the springs 33 again back into their starting position. As a result, there is accomplished the acceleration and movement of the previously non-moved chain contents, through a path corresponding to the spacing of two cartridge holders 40, wherein, however, for this movement there is available up to five-sixths of a firing interval.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A cartridge feed apparatus for automatic guns, comprising:

an endless chain means for feeding and storing the cartridges;

means for driving the endless chain means selectively in each of two possible directions of movement;

an outfeed means for outfeeding the cartridges by the conveying movement of the endless chain means;

said outfeed means being structured and arranged for outfeeding the cartridges in both directions of conveying of the endless chain means; and means for infeeding the cartridges to the automatic gun from a single feed path.

2. The cartridge feed apparatus as defined in claim 1, further including:

means for selectively turning-on and turning-off said outfeed mechanism.

3. The cartridge feed apparatus as defined in claim 1, wherein:

said outfeed mechanism comprises a rotatable outfeed element; and means drivingly connecting said rotatable outfeed element with the endless chain means.

4. The cartridge feed apparatus as defined in claim 1, wherein:

said driving means includes a respective drive means provided to each side of the outfeed mechanism for driving the endless chain means.

5. The cartridge feed apparatus as defined in claim 4, wherein:

each said respective drive means comprises a drive gear.

6. The cartridge feed apparatus as defined in claim 1, wherein:

said endless chain means for feeding and storing the cartridges includes at least a pair of chains interconnecting a single group of cartridge holders therebetween.

7. The cartridge feed apparatus as defined in claim 1, wherein:

said outfeed mechanism comprises a rotatable outfeed element; and means drivingly connecting said rotatable outfeed element with the endless chain means for both of the directions of conveying of the endless chain means.

8. A cartridge feed apparatus for automatic guns, comprising:

an endless chain means for feeding and storing the cartridges;

means for driving the endless chain means selectively in each of two possible directions of movement;

an outfeed mechanism for outfeeding the cartridges by the conveying movement of the endless chain means;

said outfeed mechanism being structured and arranged for outfeeding the cartridges in both directions of conveying of the endless chain means;

said outfeed mechanism comprises a rotatable outfeed element;

means drivingly connecting said rotatable outfeed element with the endless chain means; and said drivingly connectable means embody selectively connectable and disconnectable coupling means arranged between the outfeed element and the endless chain means.

9. A cartridge feed apparatus for automatic guns, comprising:

an endless chain means for feeding and storing the cartridges;

means for driving the endless chain means selectively in each of two possible directions of movement;

an outfeed mechanism for outfeeding the cartridges by the conveying movement of the endless chain means;

said outfeed mechanism being structured and arranged for outfeeding the cartridges in both directions of conveying of the endless chain means;

said outfeed mechanism comprises a rotatable outfeed element;

means drivingly connecting said rotatable outfeed element with the endless chain means; and said outfeed element comprises a cam shaft.

10. A cartridge feed apparatus for automatic guns, comprising:

an endless chain means for feeding and storing the cartridges;

means for driving the endless chain means selectively in each of two possible directions of movement;

an outfeed mechanism for outfeeding the cartridges by the conveying movement of the endless chain means;

said outfeed mechanism being structured and arranged for outfeeding the cartridges in both directions of conveying of the endless chain means;

said outfeed mechanism comprises a rotatable outfeed element;

means drivingly connecting said rotatable outfeed element with the endless chain means; and said outfeed mechanism comprises rail means which, at the region of the outfeed element, describe an arc for deflecting the endless chain means in the direction of the gun.

11. A cartridge feed apparatus for automatic guns, comprising:

an endless chain means for feeding and storing the cartridges;

means for driving the endless chain means selectively in each of two possible directions of movement;

an outfeed mechanism for outfeeding the cartridges by the conveying movement of the endless chain means;

said outfeed mechanism being structured and arranged for outfeeding the cartridges in both directions of conveying of the endless chain means;

said driving means includes a respective drive means provided to each side of the outfeed mechanism for driving the endless chain means;

each said respective drive means comprises a drive gear; and a respective spring mounted sprocket wheel operatively associated with each drive gear at a side thereof extending along the endless chain means and facing away from the outfeed mechanism.

12. A cartridge feed apparatus for an automatic gun, comprising:

an endless chain means movable in two conveying directions for feeding and storing the cartridges;

means for outfeeding the cartridges as a function of the conveying movement of the endless chain means;

said outfeeding means outfeeding the cartridges in both directions of conveying of the endless chain means; and means for infeeding the cartridges to the automatic gun from a single feed path.

* * * * *